United States Patent [19]

Honke

[11] 4,368,925

[45] Jan. 18, 1983

[54] CUTTER DRUM ASSEMBLY FOR A LONGWALL MINING MACHINE

[75] Inventor: Heinrich Honke, Bochum, Fed. Rep. of Germany

[73] Assignee: Gebr. Eickhoff Maschinen fabrik und Eisengiesserei, m.b.H., Bochum, Fed. Rep. of Germany

[21] Appl. No.: 240,506

[22] Filed: Mar. 4, 1981

[30] Foreign Application Priority Data

Mar. 14, 1980 [DE] Fed. Rep. of Germany ..... 3009771

[51] Int. Cl.[3] ..... E21C 35/20; E21C 35/22

[52] U.S. Cl. ..... 299/45; 299/81

[58] Field of Search ..... 299/45, 81

[56] References Cited

U.S. PATENT DOCUMENTS 3,897,110 7/1975 Agnew ..... 299/81 X 4,212,497 7/1980 Borowski et al. ..... 299/81 X

*Primary Examiner*—Ernest R. Purser

*Attorney, Agent, or Firm*—Thomas H. Murray

[57] ABSTRACT

A cutter drum assembly for a longwall mining machine of the type having a cowl pivotal about the axis of the drum and nozzles on the periphery of its spiral conveying flights for directing a trickle of liquid onto the face area being mined. The cowl, which is normally on the side of the drum opposite the face being mined, carries a cam which controls valves supplying liquid to the nozzles such that at any time water is delivered only from those nozzles adjacent the working face area.

4 Claims, 2 Drawing Figures

CUTTER DRUM ASSEMBLY FOR A LONGWALL MINING MACHINE

BACKGROUND OF THE INVENTION

Figure 1:
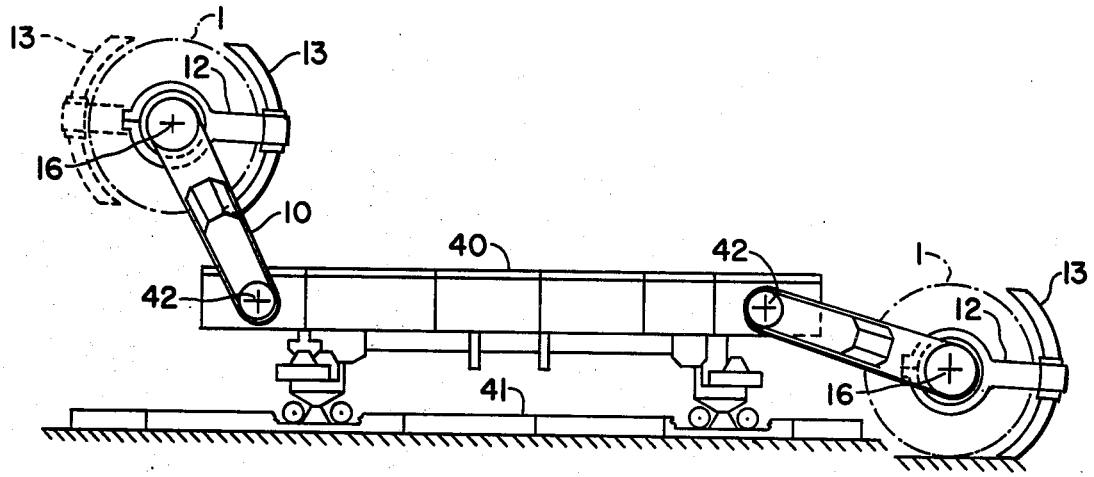

The present invention relates to a longwall mining machine of the type having a pivot arm which supports a cutter drum for rotation about an axis for working a mine face. A cowl or clearing shield is positioned at a desired location about the periphery of the cutter drum, specifically on the side of the drum opposite the face being mined. In a mining machine of this type, the rotating cutter drum cuts the material being mined and is provided with spirals which assist in loading the mined material onto a face conveyor. Loading efficiency is improved with the use of the cowl which comprises an arcuate plow which follows behind the cutter drum and which can be pivoted from one side of the drum to the other, depending upon the direction of movement of the mining machine.

In a mining machine of the type described above, the cutter drums often carry nozzles on the periphery of their spiral conveying flights for directing a trickle of liquid onto the face area being mined. The flow of liquid to the nozzles is controlled by valves spaced around the axis of the drum; and these valves are actuated such that liquid is delivered only from those nozzles immediately adjacent the working face.

In U.S. Pat. No. 1,473,498, a cutter drum assembly for mining machines is disclosed wherein the nozzles on the periphery of the cutting drum are connected through conduits and valves to a source of liquid under pressure, these valves being actuated to deliver liquid to the nozzles immediately adjacent the working face by a cam which does not rotate with the cutter drum itself.

In German Offenlegungsschrift No. 2,808,915, a cutter drum assembly is disclosed wherein water under pressure is supplied only to spray nozzles on the drum periphery near that sector of the drum which is actually cutting, and wherein that portion of the drum periphery opposite the face area is covered by a cowl. The cowl is arranged to pivot around the rotational axis of the shearer drum and, through the agency of a special pivoting mechanism at the end of the path of travel of the mining machine, is pivoted into that peripheral zone of the shearer drum which is opposite the face area being mined.

SUMMARY OF THE INVENTION

In accordance with the present invention, a new and improved cutter drum assembly for longwall mining machines and the like is provided having nozzles on the periphery of its spiral conveying flights, together with improved means for actuating valves for supplying liquid under pressure to the nozzles only in that peripheral portion of the drum which is immediately adjacent the working face.

Specifically, a cutter drum assembly having nozzles on the periphery of its spiral flights is provided having a cowl pivotal about the axis of the drum. The cowl carries a cam which, in turn, actuates valves for supplying liquid under pressure to the nozzles, the cam configuration being such that only those nozzles opposite the cowl will be connected to a source of liquid under pressure as the drum rotates. Since. the cowl is disposed on the side of the drum which is remote from the working face, only those nozzles which are adjacent the working face will deliver liquid under pressure. With this arrangement, manual adjustment of the valve-operating cam for various conditions of operation becomes unnecessary.

Figure 2:
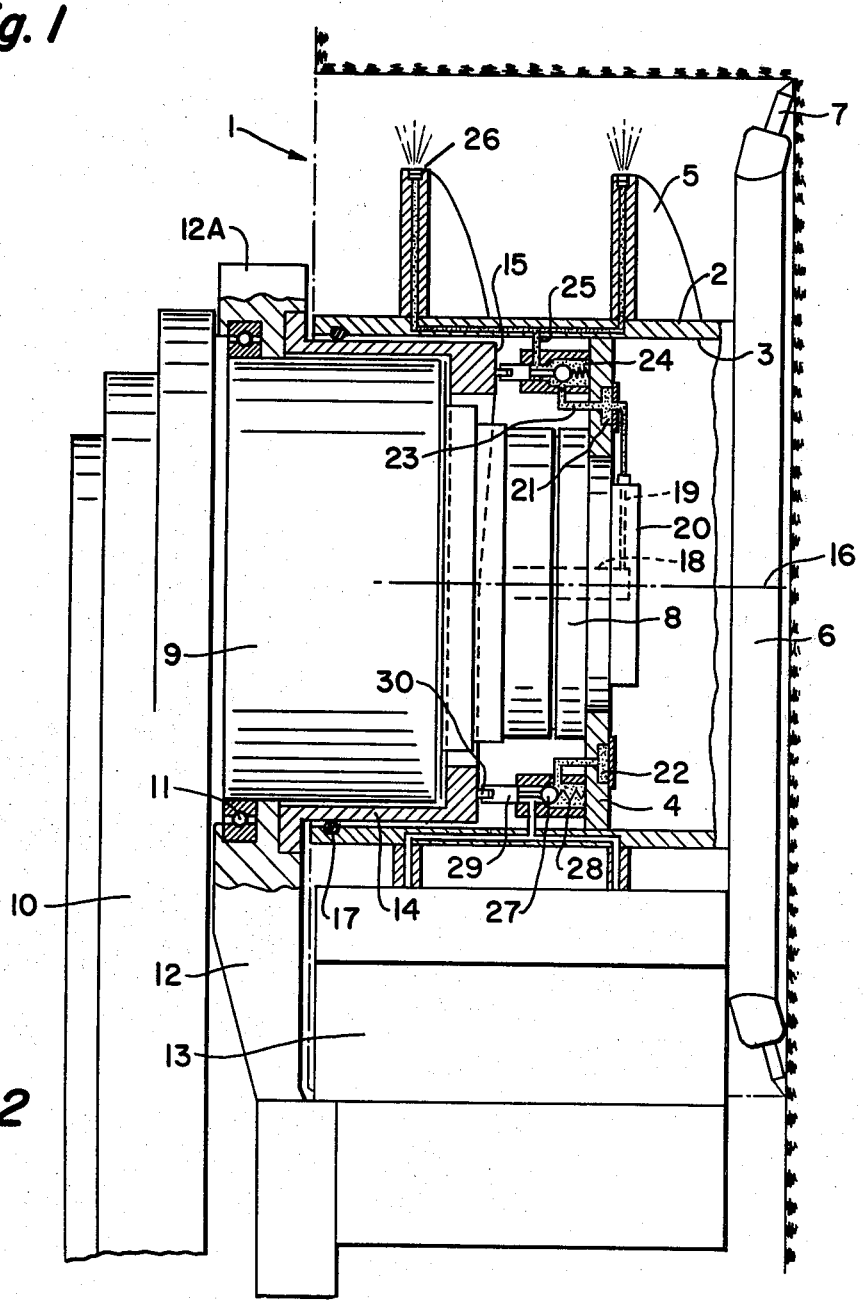

The above and other objects and features of the invention will become apparent from the following detailed description taken in connection with the accompanying drawings which form a part of this specification, and in which:

FIG. 1 is a side view of a longwall mining machine with which the present invention can be used; and FIG. 2 is a cross-sectional view of the cutter drum assembly of the invention.

With reference now to the drawings, and particularly to FIG. 1, there is illustrated a longwall cutter drum mining machine 40 which is supported for movement on a face conveyor 41 in a manner well known in the art. The mining machine 40 includes a cutter drum 1 at each end of the machine mounted on a support arm 10 adapted to pivot about axis 42 from the lower position shown at the right of the machine to an elevated position shown at the left of the machine. As will be seen, the cutter drums 1 remove coal or other mineral material from the mine face and are provided with spirals which convey the mined material backwardly onto the conveyor 41 where it is transported away from the face area.

Pivotal about the axis of rotation 16 of each cutter drum 1 is a cowl support arm 12 which carries at its outer extremity the cowl 13 itself. The cowl is pivotal from the full-line position shown in FIG. 1, for example, to the broken-line position illustrated on the left-hand drum 1. It serves to direct coal being mined onto the face conveyor and can be provided with water sprays which reduce the possibility of excessive coal dust escaping into the atmosphere.

Details of the cutter drum assembly are shown in FIG. 2. It includes a tubular hub 2 having welded to its inner periphery a connecting disc 4. The disc, in turn, is mounted on a hub 8 rotatably connected to reduction gearing, not shown, contained within a tubular gearbox 9 carried on the support arm 10. One or more spiral flights 5 extend around the hub 2 and are welded to the periphery thereof. Mounted on the forward edge of the hub 2 is a closure disc 6 which carries on its periphery shearing tools 7. The flights 5 also carry on their peripheries nozzles 26 and shearing tools, not shown, which are inclined in the direction of rotation of the drum. The cowl support arm 12, which carries the cowl 13, is mounted for pivotal movement on the gearcase 9 by means of bearing 11. The bearing 11 is positioned within an annular opening formed in a ring-like extension 12A of the cowl support arm 12.

Secured to the ring portion 12A and extending into the interior of the hub 2 is an annular member 14. The inner edge 15 of the annular member 14 extends curvilinearly along the axis 16 of the drum and serves as a cam as will be explained in greater detail hereinafter. At its inner end, the hub 2 has formed on its inner periphery 3 an annular groove which receives an O-ring seal 17 which acts to seal the gap between the hub 2 and the annular member 14 and keeps dust and dirt out of the hub interior.

High-pressure liquid is supplied to the drum 1 through a central bore 18 extending through the gearcase 9. Bore 18, in turn, communicates with one or more radial passageways 19 in a distribution disc 20 carried on hub 8. Passageways 19, in turn, are connected through hoses 21 to an annular duct 22 formed in annular connecting flange 4. The annular duct 22, in turn, is connected through conduits 23 to a series of circumferentially-spaced control valves 24. The outlet ports of the control valves 24 are connected through conduits 25 to sectors of the various nozzles 26 circumferentially spaced around the peripheries of the flights 5.

Each of the valves 24 is provided with a spherical valve element 27 which is biased by means of a spring 28 against a valve seat. A rod 29 provided in each valve 24, is disposed parallel to the drum axis 16, and is positioned on that side of the spherical valve element 27 which is remote from the spring 28. Pressure acting on the valve elements 27 causes the rods 29 to move to the left as viewed in FIG. 2 such that they bear by means of rollers 30 on the curvilinear cam face 15 of annular member 14. As the drum 1 rotates, each rod 29 will perform an oscillating motion, acting on its associated spherical valve element 27 to alternately open and close its associated valve 24. When the cowl 37 is pivoted, for example, from the full-line position to the dotted-line position shown at the right of FIG. 1, the annular member 14 and its curvilinear cam face 15 move to a position in which the cam face 15 actuates only the valves 24 of a particular sector of the drum as the same rotates. As can be seen from FIG. 2, the valve or valves 24 adjacent the cowl support arm 12 are closed while that diametrically opposite the support arm 12 is open. Since the cowl 13 and its support arm 12 are always diametrically opposite the portion of the shearer drum immediately adjacent the face being mined, only those nozzles adjacent the face will deliver liquid under pressure with successive sectors of the nozzles delivering liquid as the drum rotates.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. In a shearer drum assembly for a mining machine having nozzles on its periphery for delivering liquid under pressure to a face area being mined, the combination of a cowl pivotal around the axis of the drum assembly, valves spaced around the periphery of the drum assembly for controlling the flow of liquid to said nozzles, and cam means pivotal with said cowl and arranged to actuate said valves such that at any time liquid is delivered only from those nozzles essentially diametrically opposite the cowl.

2. The shearer drum assembly of claim 1 wherein each of said valves controls the flow of liquid only to those nozzles disposed in an arcuate portion of the periphery of the shearer drum.

3. The shearer drum assembly of claim 1 wherein said cowl is mounted on an arm rotatable around the axis of the shearer drum assembly, said cam means being carried by said arm.

4. The shearer drum assembly of claim 1 including conduit means extending through said shearer drum assembly for connecting a source of fluid under pressure to said valves, and conduit means connecting said valves to selected ones of said nozzles.

* * * * *